US007622688B2

(12) United States Patent
Baertl et al.

(10) Patent No.: US 7,622,688 B2
(45) Date of Patent: Nov. 24, 2009

(54) TAP CHANGER

(75) Inventors: Reinhold Baertl, Lappersdorf (DE); Albert Schmidbauer, Roding (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 103 days.

(21) Appl. No.: 11/885,680

(22) PCT Filed: Nov. 17, 2005

(86) PCT No.: PCT/EP2005/012311

§ 371 (c)(1),
(2), (4) Date: Sep. 4, 2007

(87) PCT Pub. No.: WO2006/092164

PCT Pub. Date: Sep. 8, 2006

(65) Prior Publication Data

US 2008/0169178 A1 Jul. 17, 2008

(30) Foreign Application Priority Data

Mar. 1, 2005 (DE) ..... 10 2005 009 193

(51) Int. Cl.
*H01H 3/08* (2006.01)

(52) U.S. Cl. ..... 200/336; 200/17 R

(58) Field of Classification Search ..... 200/6 R, 200/11 TC, 11 A, 1 R, 12–14, 17 R, 18, 11 K, 200/400, 284, 11 R
See application file for complete search history.

(56) References Cited

U.S. PATENT DOCUMENTS 2,727,613 A 12/1955 Radkowski
4,527,022 A * 7/1985 Vazquez ..... 200/8 R
4,604,503 A * 8/1986 Fuwa ..... 200/11 TC
5,056,377 A * 10/1991 Yatchum et al. ..... 74/436
5,191,179 A * 3/1993 Yatchum et al. ..... 200/11 TC
5,488,212 A * 1/1996 Fukushi et al. ..... 200/400
5,523,535 A * 6/1996 Larsson et al. ..... 200/11 TC
5,834,717 A * 11/1998 Neumeyer et al. ..... 200/17 R
6,091,032 A * 7/2000 Dohnal et al. ..... 200/11 TC
6,833,518 B1 * 12/2004 Byers et al. ..... 200/11 TC
6,838,629 B2 * 1/2005 Baertl ..... 200/501
7,482,714 B2 * 1/2009 Rapant et al. ..... 307/137

FOREIGN PATENT DOCUMENTS

CH 331114 8/1958
DE 454821 1/1928

* cited by examiner

*Primary Examiner*—Michael A Friedhofer
*Assistant Examiner*—Lisa N Klaus
(74) *Attorney, Agent, or Firm*—Andrew Wilford

(57) ABSTRACT

A tap changer has an insulating housing and a plurality of annular arrays of contacts fixed in the housing. A vertical switching shaft in the housing carries contacts positioned to engage the fixed contacts of the respective array on rotation of the shaft. A tap-changer head closes an upper end of the housing, and a head flange above the tap-changer head is formed with threaded fastening bores. A geneva transmission on the tap-changer head has an output connected to the shaft and an input shaft projecting vertically upward from the head into the head flange. An upper transmission stage boltable to the bores on the head flange is connectable to the input shaft. A handwheel drive has a flange with an upper cover through which the input shaft extends and a handwheel or hex fitting on an upper end of the input shaft.

2 Claims, 2 Drawing Sheets

TAP CHANGER

CROSS REFERENCE TO RELATED APPLICATIONS

Figure 1:
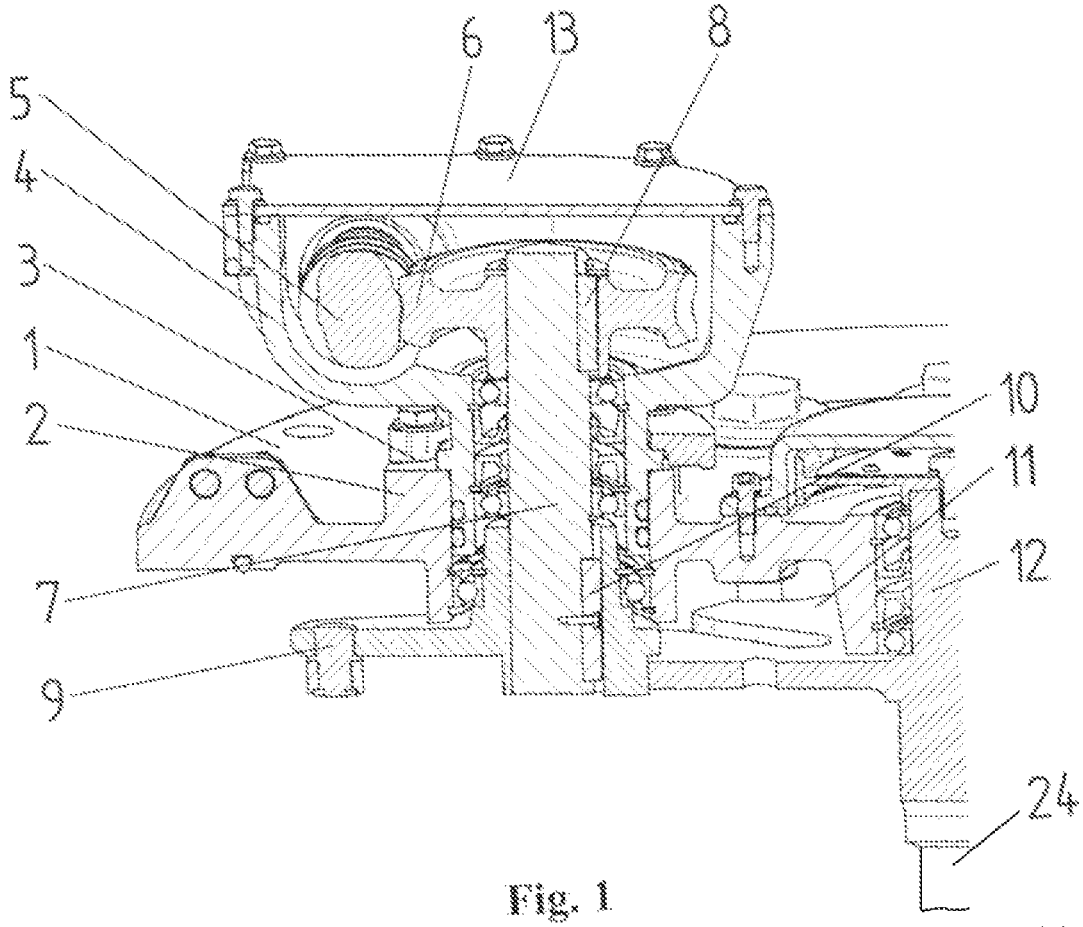

This application is the US national phase of PCT application PCT/EP2005/012311, filed 17 Nov. 2005, published 8 Sep. 2006 as WO2006/092164, and claiming the priority of German patent application 102005009193.8 itself filed 1 Mar. 2005, whose entire disclosures are herewith incorporated by reference.

FIELD OF THE INVENTION

The invention relates to a tap changer for no-load switching between different winding taps of a tapped transformer for voltage setting.

BACKGROUND OF THE INVENTION

Such a tap changer is already known from the company publication of the applicant "Umsteller DEETAP® U, Betriebs-anleitung BA 249/02de," printing 0204/200. This known tap changer operates according to the principle of the rotary tap changer. It comprises a dielectric housing on which fixed contacts are arrayed in circles in each of several horizontal planes. A rotatable insulated switching shaft is disposed in the interior of this dielectric housing and carries in each horizontal plane at least one switching contact that can make an electrical connection with the corresponding fixed contacts in different ways depending on the respective basic circuit, for example as a star-point tap changer, simple center tap changer, double center tap changer, series-parallel tap changer or star-delta tap changer.

The adjusting of the tap changer from one operating setting to another, i.e. the switching between different winding taps of the connected tapped transformer, is carried out by rotation of the insulated switching shaft when the transformer is switched off, i.e. in the current-free and voltage-free state. Rotation of the insulated switching shaft is usually effected by a stepping drive having an electric motor drive or a mechanical manual drive acts as shall be explained in more detail in the following.

The upper closure of the known tap changer forms the tap changer head with the attached upper transmission stage and the Geneva transmission, which is disposed thereunder, for driving the insulated switching shaft. A shaft extending from the motor or manual drive is connected with an outer shaft coupling at the upper transmission stage; the rotational movement of the shaft is transmitted to the upper transmission stage by way of a worm gear on a drive shaft which is vertically mounted in the tap changer head and which in turn has a Geneva crank at its lower end. The Geneva crank engages in a Geneva wheel fixed on the insulated switching shaft at the upper end.

A switching step, i.e. a rotation of the insulated switching shaft through a defined angle with respect to the respective adjacent fixed contact, thus corresponds with a defined number, which is dependent on type, of revolutions of the driving shaft of the motor or manual drive.

Certain variants of the known tap changer have instead, as a special construction, a direct mechanical actuation possibility of the insulated switching shaft by a handwheel, which is connected therewith and arranged centrally on the tap changer head, or a hex fitting in conjunction with a socket wrench. Due to the direct central connection a special tap changer head is required for these constructions. This leads to an undesired variant multiplication of necessary pads of an otherwise identical tap changer.

OBJECT OF THE INVENTION

It is accordingly the object of the invention to provide a tap changer as described above that avoids these disadvantages and in which all described actuation possibilities of the insulated switching shaft can be realized by a single tap changer head.

SUMMARY OF THE INVENTION

This object is fulfilled by a tap changer having only a single tap changer head with a head flange, to which an upper gear stage for actuation by a motor or manual drive or a handwheel drive flange for actuation by a handwheel or by means of a hex fitting can be selectably fastened. The drive shaft which, as described, carries the Geneva crank at its lower end is also identical for all forms of actuation.

BACKGROUND OF THE INVENTION

Figure 2:
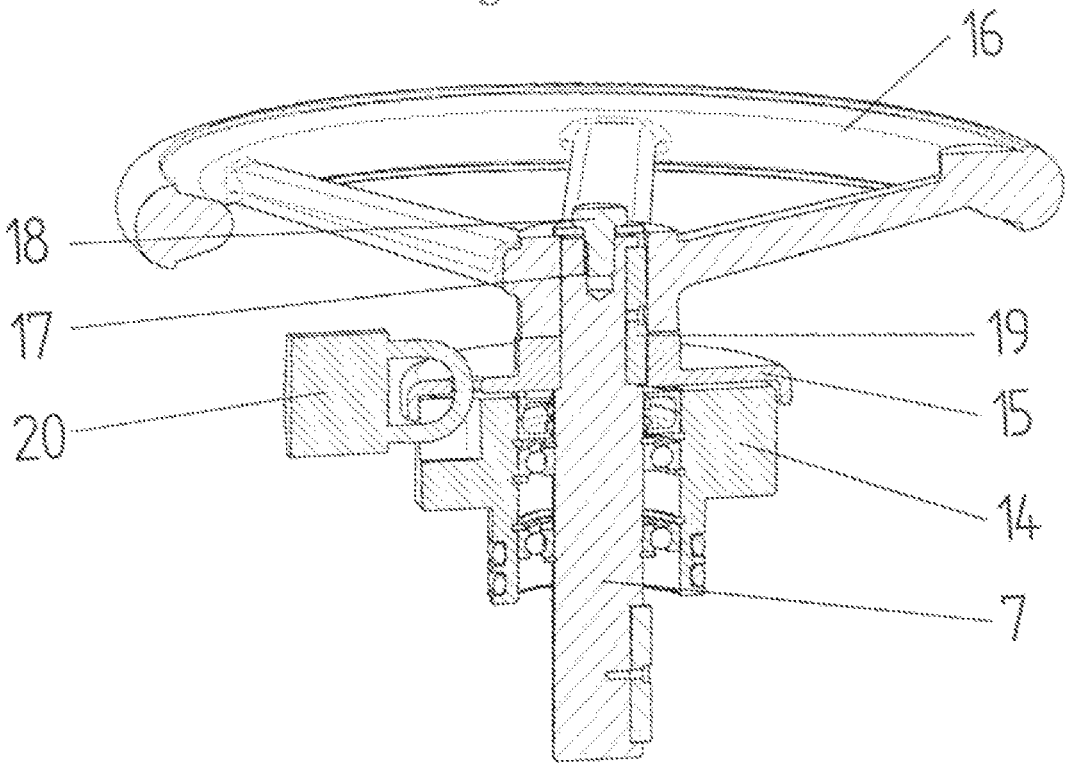
Figure 3:
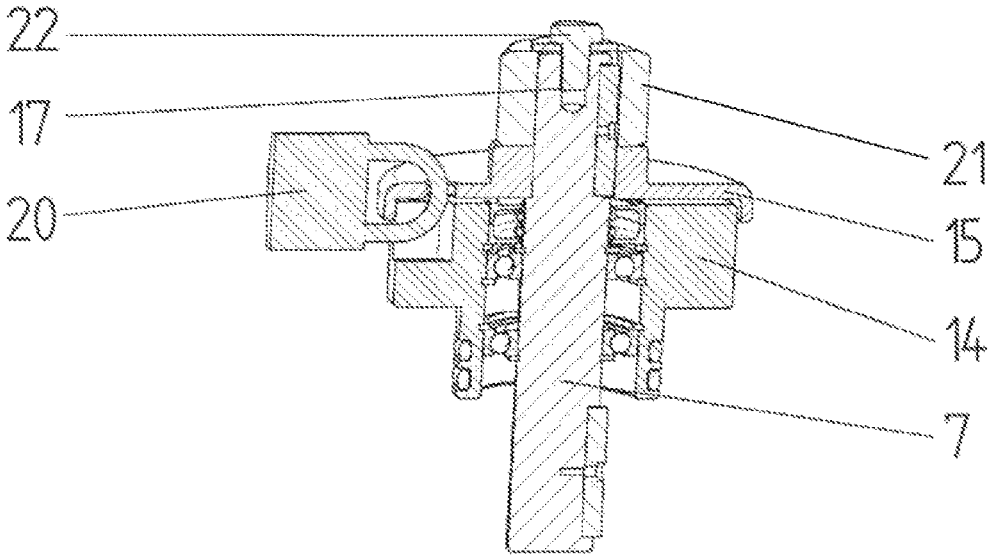
Figure 4:
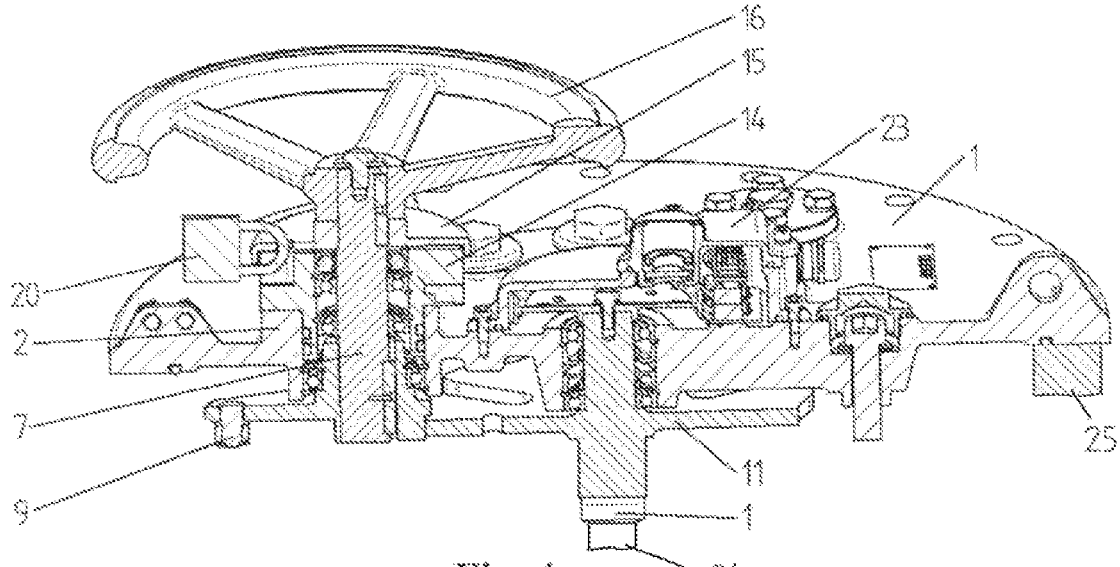

The invention shall be explained in more detail in the following by way of examples of embodiment, wherein:

FIG. 1 shows part of the tap changer head of a tap changer according to the invention with an upper transmission stage mounted on the head flange, FIG. 2 shows a handwheel drive with a handwheel drive flange which can be mounted instead of the upper transmission stage, FIG. 3 shows a hex drive with, again, a handwheel drive flange which can be mounted instead of the upper transmission stage and FIG. 4 shows a cross-section of the complete tap changer head of a tap changer according to the invention, here with a mounted handwheel drive at the head flange.

SPECIFIC DESCRIPTION

Initially, FIG. 1 shall be explained. Here, a tap changer head 1 is shown which comprises a head flange 2 with several concentrically arranged threaded fastening bores 3 for securing to a dielectric housing 25 (FIG. 4). An upper transmission stage 4 is mounted on the head flange 2. This upper transmission stage 4 has, in a manner known per se, a worm gear 5 mounted on a shaft (not illustrated) extending from the motor drive or manual drive. The worm 5 acts on a gear wheel 6 fastened to the vertically extending drive or input shaft 7. Rotational coupling is effected by a key-and-groove connection 8. The drive shaft 7 is mounted in the head flange 2. A Geneva crank 9 is fastened to the drive shaft 7 at its lower end; a further key-and-groove connection 10 serves for the necessary rotational coupling. The Geneva crank 9 acts on a Geneva wheel 11 fastened by its flange 12 to the upper part of an insulated switching shaft 24. The upper transmission stage 4 is closed at the top by a cover 13. In the embodiment illustrated in this figure the drive of the tap changer thus takes place by way of a physically separately arranged motor drive or even a manual drive, rotation being transmitted by a corresponding shaft assembly to the worm 5 of the upper transmission stage 4.

The components of an alternatively usable handwheel drive are shown in FIG. 2. Provided for this purpose is a handwheel drive flange 14 similarly fastenable to the head flange 2—not shown here—and in which the drive shaft 7 is mounted. The handwheel drive flange 14 has an upper cover

15 through which the drive shaft 7 extends. A handwheel 16 is fastened to the drive shaft 7 at its upper end. The fastening is effected by a threaded bore 17 at the end of the drive shaft 7 and the handwheel 16 is fastened by means of a screw 18; here, too, a key-and-groove connection 19, which corresponds in its physical position with the key-and-groove connection 8 in FIG. 1, is provided for rotational coupling. A safety lock 20 can be provided in order to prevent unauthorized adjustment.

An alternatively usable hexagon drive is shown in FIG. 3. It again has the handwheel drive flange 14 in which the drive shaft 7 is mounted. However, here instead of a handwheel a hexagon fitting 21 is fastened above the cover 15 again by means of a screw 22 in the thread 17 of the drive shaft 7.

The entire tap changer head of a tap changer according to the invention, here with mounted handwheel drive, is shown again in FIG. 4. It can be seen that the head flange 2 as well as the entire tap changer head 1 are completely identical to the embodiment of FIG. 1, with the upper transmission stage. Instead of the upper transmission stage the handwheel drive flange 14 is here mounted on the head flange 2. The handwheel 16 acts on the drive shaft 7 and on the Geneva crank 9 arranged at the lower end and this in turn on the Geneva wheel 11 forming with the crank a Geneva transmission and thereby the insulated switching shaft 24. In this illustration for the sake of completeness an additionally arranged, known switch monitoring device 23 is also indicated, but is of no relevance to the invention and accordingly is not explained in more detail.

It can be seen that with the tap changer according to the invention, thus independently of whether the drive takes place by way of a motor drive or manual drive and a corresponding upper transmission stage or a handwheel drive or also a hex drive, the same transmission mechanism always transmits the rotation: from the drive shaft 7 by way of the Geneva crank 9 to the Geneva wheel 11 and from there to the insulated switching shaft 24. This has the consequence that for every form of actuation the same number of revolutions is required in order to execute an actuation of the tap changer. It can be seen that in the tap changer according to the invention the type multiplicity has been substantially reduced; the head flange 2 has the function of an adapter on which the upper transmission stage 4 or handwheel drive flange 14 can be selectably mounted without further different components being required apart from the handwheel 16 and hexagon adapter 21 themselves.

The invention claimed is:

1. A tap changer comprising:

an insulating housing centered on a vertical axis;

a vertical insulated switching shaft extending in the housing along the axis;

a tap-changer head closing an upper end of the housing;

a head flange above the tap-changer head formed with threaded fastening bores;

a geneva transmission carried on the tap-changer head and having an output connected to the shaft and an input shaft projecting vertically upward from the head into the head flange;

an upper transmission stage boltable to the bores on the head flange and connectable to the input shaft; and a handwheel drive having a flange with an upper cover through which the input shaft extends and a handwheel or hex fitting on an upper end of the input shaft.

2. The tap changer defined in claim 1 wherein the input shaft has at its upper end a screwthread and the handwheel or hex fitting includes a screws engaged with the screwthread.

* * * * *